US007766579B2

(12) United States Patent
Aristaghes et al.

(10) Patent No.: US 7,766,579 B2
(45) Date of Patent: Aug. 3, 2010

(54) PROCESS AND DEVICE FOR BUILDING A TUNNEL IMMERSED ON A SUB-SEA SOIL

(75) Inventors: Pierre Aristaghes, Voisins le Bretonneux (FR); Pierre Longchamp, Villeneuve (FR); Philippe Autuori, Fontenay Aux Roses (FR); Patrick Palbras, Bretigny sur Orge (FR)

(73) Assignee: Bouygues Travaux Publics, Guyancourt (FR)

( * ) Notice: Subject to any disclaimer, the term of this patent is extended or adjusted under 35 U.S.C. 154(b) by 705 days.

(21) Appl. No.: 11/579,931

(22) PCT Filed: May 11, 2005

(86) PCT No.: PCT/IB2005/001741

§ 371 (c)(1),
(2), (4) Date: Nov. 8, 2006

(87) PCT Pub. No.: WO2005/111317

PCT Pub. Date: Nov. 24, 2005

(65) Prior Publication Data

US 2007/0248416 A1 Oct. 25, 2007

(30) Foreign Application Priority Data

May 12, 2004 (FR) ..... 04 05129

(51) Int. Cl.
*E02D 29/063* (2006.01)

(52) U.S. Cl. ..... 405/137; 405/170

(58) Field of Classification Search ..... 405/136, 405/137, 159, 170
See application file for complete search history.

(56) References Cited

U.S. PATENT DOCUMENTS

| | | | | | |
|---|---|---|---|---|---|
| 413,383 | A | * | 10/1889 | Beecher | 405/137 |
| 618,955 | A | * | 2/1899 | Gahagan | 37/313 |
| 715,768 | A | * | 12/1902 | Dunham | 405/135 |
| 888,790 | A | * | 5/1908 | Douglas | 405/136 |
| 1,098,961 | A | * | 6/1914 | Mosher | 405/136 |
| 1,441,698 | A | | 1/1923 | Meem | |
| 3,656,309 | A | * | 4/1972 | Bultema | 405/170 |
| 3,785,160 | A | * | 1/1974 | Banjavich et al. | 405/170 |
| 4,345,854 | A | * | 8/1982 | Valantin | 405/159 |
| 4,657,435 | A | * | 4/1987 | Chang | 405/136 |
| 4,889,448 | A | | 12/1989 | Bell | |

FOREIGN PATENT DOCUMENTS

| | | |
|---|---|---|
| DE | 50882 | 5/1889 |
| DE | 20 36 953 A1 | 2/1972 |

(Continued)

*Primary Examiner*—Tara Mayo-Pinnock
(74) *Attorney, Agent, or Firm*—Blakely, Sokoloff, Taylor & Zafman

(57) ABSTRACT

A tunnel is built in successive sections by a machine suitable for operating at the surface and in immersion that is displaced in the water on the sub-sea soil. This machine includes a fluid-tight working space (6) for accommodating the personnel and equipment required for construction. Further, this space has a rearward-facing opening for building and erecting a section at the rear of the machine. The forward section of the machine includes a ballastable chamber (7) which prepares and grades the soil for erection of a section.

33 Claims, 5 Drawing Sheets

FOREIGN PATENT DOCUMENTS

| | | |
|---|---|---|
| DE | 33 33 850 | 12/1984 |
| EP | 0899422 | 3/1999 |
| GB | 0348204 | 5/1931 |
| JP | 02024489 | 1/1990 |
| JP | 09316901 | 9/1997 |
| JP | 09 273382 | 10/1997 |

* cited by examiner

PROCESS AND DEVICE FOR BUILDING A TUNNEL IMMERSED ON A SUB-SEA SOIL

CROSS-REFERENCES TO RELATED APPLICATIONS

This is a non-provisional application claiming the benefit of International application number PCT/IB2005/001741 filed May 11, 2005

STATEMENTS REGARDING FEDERALLY SPONSORED RESEARCH FOR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention concerns construction of a tunnel immersed beneath a body of water.

2. Description of Related Art Including Information Disclosed Under 37 CFR 1.97 and 1.98

Numerous techniques have been proposed for building a tunnel beneath a body of water, generally beneath a body of sea water.

Some techniques concern the case where the tunnel is to be built essentially in the underlying ground at the bottom of the body of water, as illustrated, for example, in publications DE 50 882, JP 9 316 901, GB 348 204, EP 0 899 422, JP 09-273382, JP 2 024 489, U.S. Pat. No. 1,441,698, U.S. Pat. No. 4,889,448.

In fact, a widespread solution in this case consists in using a tunnel boring machine to bore the earth, remove the bored material to the rear of the tunnel boring machine, and build the tunnel in successive sections as the tunnel boring machine advances, as for construction of a tunnel through mountains.

A tunnel built in this manner beneath the bottom of a body of water has the advantage of constituting no obstacle to water traffic but on the contrary, among other disadvantages, requires construction of approach works whose length will be proportional to the depth at which the tunnel lies beneath the bottom of the body of water.

BRIEF SUMMARY OF THE INVENTION

This invention concerns the case where the tunnel is to be built partially or totally in water on a natural or artificial sub-sea or sub-river soil and in what follows the expression sub-sea soil will be interpreted as covering all these cases.

Publication DE 33 33 850 describes a technique wherein the tunnel is built in successive sections precast in a fluid-tight excavation and gradually pushed into the water to their service position.

Another standard technique consists in building annular tunnel sections at the surface (on land or a floating vessel), conveying them to their place of launching, sinking them to their final position on the sub-sea soil and assembling them together.

Such a technique requires having a site suitable for a casting basin where the sections can be built, or a facility for launching sections precast on land, and causes major disturbance to water traffic, particularly because the sections are generally very long, at several tens of meters or even a hundred metres or more.

One of the objectives of the invention is to avoid the construction of complex terrestrial infrastructures (casting basin or launching facility), to considerably reduce navigational obstacles, and to reduce construction costs and lead times.

One aspect of the invention is a process characterized in that the standard immersed section is built on the sub-sea soil (be it natural, prepared, or artificial, or resulting from preliminary dredging or backfilling) by means of a machine suitable for operating in immersion and that is made to advance in the water on the sub-sea soil, as required, along the alignment proposed for the tunnel, this machine comprising a fluid-tight working space at atmospheric pressure suitable for protecting the personnel and equipment required for construction and in situ erection of the section, in that the tunnel is kept fluid-tight as it is built, in that sufficient communication space is provided between the part of the tunnel already built and the working space in the machine to enable construction and erection of a new section, and in that the tunnel is used, as it is being built, to transport into the working space the elements of which the section is to be made, as required.

The process of the invention may, in its implementation, have one or more of the following additional advantageous characteristics, individually or in combination:

- the tunnel is built in short successive sections no more than a few metres long, preferably in unit lengths of less than 3 metres;
- the machine is used to partially or totally prepare the sub-sea soil as it advances, in readiness for laying of the tunnel, by means of tools integrated into said machine;
- the soil is prepared by grading the soil or a layer placed on top of the soil;
- a trench is dredged along the alignment proposed for construction, with added foundation material if necessary, and this excavation is graded;
- the soil is consolidated or its bearing capacity improved as the machine advances by means of tools integrated into the machine or from inside the tunnel already built;
- the machine is displaced incrementally on the sub-sea soil ahead of the last section erected in order to, on each occasion, create the space necessary for erection of the following section and injection of its permanent foundation;
- the machine is made to advance over the sub-sea soil by thrusting forward, pushing off from the part of the tunnel already built;
- the forward thrust is achieved by means of rams;
- a rearward retaining tensile force is exerted on the machine, in the direction of the part of the tunnel already built, as required to facilitate the guidance of the machine, to compress transverse seals, and to ensure the temporary stability of the latest sections erected when the frontal hydrostatic thrust on the machine is insufficient;
- this tensile force is exerted by means of a pulling device connected to the machine by a cable running through the part of tunnel already built;
- the machine is fitted with a ballastable compartment for adjusting the bearing force of the machine on the soil and to facilitate its guidance in the vertical plane;

in the ballastable chamber there are tools for preparing the soil and/or treating it for consolidation or improvement of its bearing capacity;

the machine is also used to build non-immersed, partially immersed, and/or slightly immersed approach sections of the tunnel.

Each section of tunnel may be built by any appropriate method, including assembly of precast parts and cast in place concrete.

In one particular method, each section is built as a ring obtained by assembling section segments by means of a fixed or mobile device located in the fluid-tight working space, there being longitudinal seals between segments.

According to the invention, to compensate any local absence or insufficiency of hydrostatic pressure on the tunnel or on the front of the machine in approach zones where the tunnel is not or is only slightly immersed, and to improve the individual stability of a standard section, provision is made for compressing the seals between the segments of the section by transversally prestressing the section after it has been erected.

The invention also concerns a device for implementing the procedure.

This device comprises:

a machine suitable for operating in immersion which comprises an internally fluid-tight working space under atmospheric pressure suitable for protecting the personnel and equipment required for construction of a section, said space being open to the part of the tunnel already built to enable the new section to be built;

means for ensuring fluid-tightness around the opening between the working space and the last section built;

means for preparing the tunnel foundation;

means for causing controlled forward movement of the machine on the sub-sea soil, as required, in order to create the space required for building a new section;

means for ensuring the fluid-tightness of the tunnel as it is built;

means for controlling the force the machine exerts on the sub-sea soil and against the tunnel;

means for conveying the components and power supplies necessary for construction of sections through the tunnel to the machine.

In particular embodiments, this device advantageously possesses one or more of the following characteristics, individually or in combination:

the machine is equipped with means for preparing the soil to locally improve the condition of the sub-sea soil, as required for the construction of tunnel sections;

said means of soil preparation comprise means of grading and/or means of consolidating the soil, be they robotic or otherwise;

the means of grading comprise tools for levelling the original soil or a layer placed on that soil beforehand and may also include means for checking and/or viewing the state of levelling in the control cab;

the means of grading comprise grading tools fitted to arms mounted on slides on one or more horizontal beams;

to adjust the bearing force of the machine on the sub-sea soil, the machine has a ballastable compartment;

the ballastable compartment is open at the bottom, the means for grading being housed in or being retractable inside said ballastable compartment, and the machine is equipped with means for injecting compressed air into the ballastable compartment as required;

the device comprises means for providing the force to hold the machine against the tunnel when the frontal hydrostatic thrust on the machine is insufficient;

said means are means of traction which apply rearward tensile force on the machine;

said means of traction comprise a pulling device located a distance behind the machine and connected to the machine by a cable running through the part of the tunnel already built;

the machine is equipped with means for exerting thrust on the machine in order to move it forward and to control its trajectory along the alignment for tunnel erection;

said working space is equipped with means for handling precast segments of sections in order to build a tunnel section;

the machine is equipped with rams positioned to exert thrust on the machine by pushing off the last section built;

said fluid-tight space is equipped with means for injecting a filling material into the void left by the machine as it advances, between the soil and the underside of the sections forming the tunnel;

the machine comprises a counterweight compartment;

the device comprises precast sections of tunnel of a unit length of at most several metres or segments of sections for building such sections;

the device comprises precast sections of tunnel of a unit length generally less than about 3 metres or segments of sections for building such sections.

Therefore, in its fullest elaboration, the invention consists in building a tunnel on a sub-sea soil, incrementally, by means of a special immersed machine fulfilling the functions of:

protection (and support, as required) for construction of the shell constituting the future tunnel, or of the outer casing of said shell;

gradual displacement of personnel and equipment as the tunnel advances;

a work base for any auxiliary works (foundation levelling, dredging, infilling beneath invert, backfilling, protection, soil treatment, etc.);

temporary fluid-tightness between the part of the tunnel already built and the body of the machine itself.

The structure of the tunnel may be different to that of conventional immersed-tube tunnels since the constraints are not the same:

it may be wholly or partially made of precast or cast-in-place elements, whether prestressed or otherwise;

one of more rows of columns or dividing walls may be built in order to provide one or more lines of intermediate support and/or in the case of walls, airtight separations;

it may, as in the case of conventional tunnels, be made of sections connected together by seals ensuring fluid-tightness and flexibility with respect to tunnel deformation of any kind.

a second tunnel wall may be built for waterproofing or for rigidity;

it may, as in the case of conventional tunnels, be made of sections connected together by seals ensuring fluid-tightness and flexibility with respect to differential displacements.

BRIEF DESCRIPTION OF THE SEVERAL VIEWS OF THE DRAWINGS

What follows will give a schematic description of an example of construction using the invention, referring to the figures in the attached drawing on which.

DETAILED DESCRIPTION OF THE INVENTION

Figure 1:
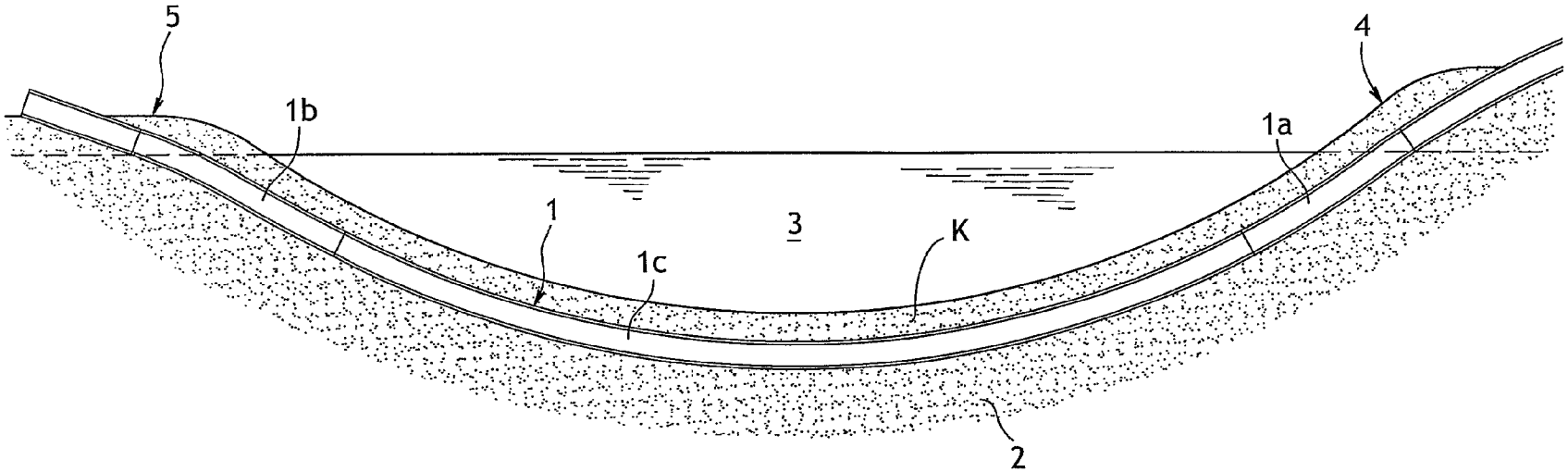
FIG. 1 is a longitudinal diagram of an example of a tunnel to be built according to the invention.

FIG. 1 very schematically shows an immersed tunnel (1) placed on a soil (2) beneath a body of water (3). This tunnel comprises two approach portions (1*a*, 1*b*) which reach the surface, for example on the banks or shores (4) and (5) of the body of water (3), and a main immersed portion (1*c*). After construction, the tunnel has been covered with protective fill (K) (optional).

The immersed portion and preferably also the approach portions reaching the surface and the slightly immersed portions of the tunnel are made up of successive sections whose cross section is determined in accordance with the use of the tunnel, in manner known per se.

In the example, the cross sections of FIGS. 2 to 6 show the standard section of a dual two-lane twin-cell tunnel whose cross section forms a figure eight.

According to the invention, the tunnel is built in successive sections of a unit length of about one metre.

Figure 2:
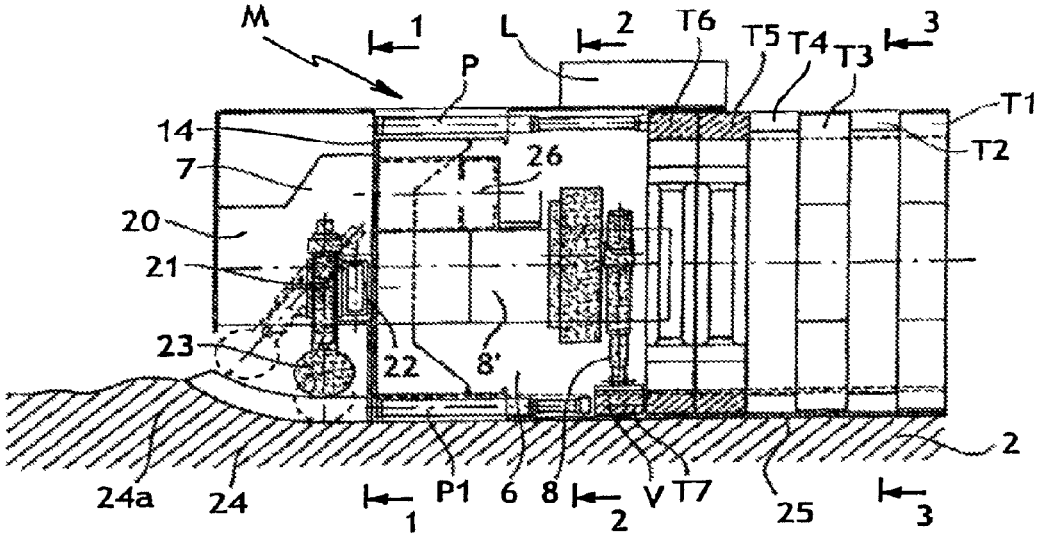
FIG. 2 is a longitudinal section of part of the tunnel already built and of the machine designed and used, according to the invention, to build the tunnel.

FIG. 2 shows six sections, T1-T6, already in place and the start of erection of a new section.

Figure 3:
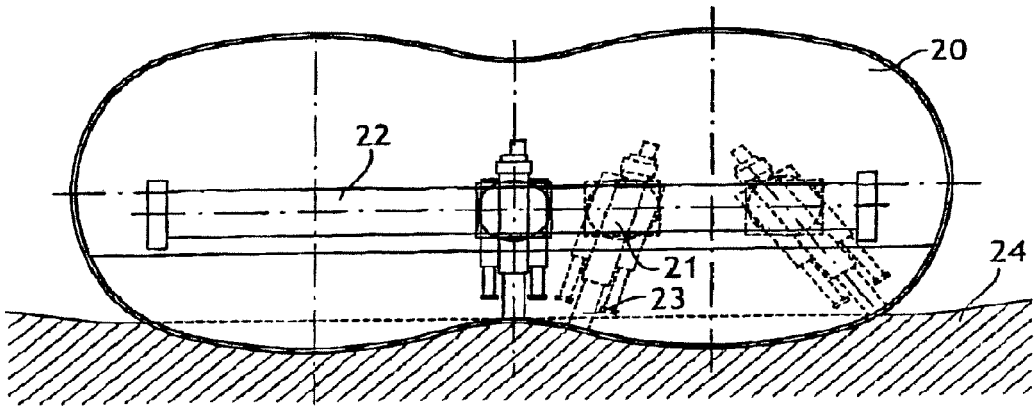
FIGS. 3 to 5 are cross sections in planes 1-1, 2-2 and 3-3 of FIG. 2.

The machine (M) used according to the invention is shown only very schematically on FIG. 3 but sufficiently for the man skilled in the art.

Figure 7:
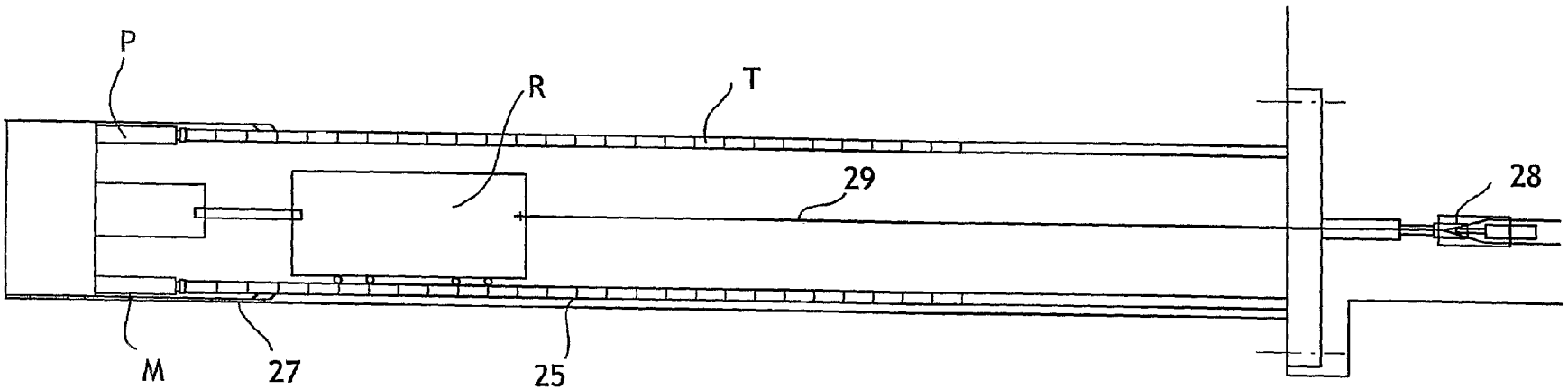
FIG. 7 is a longitudinal diagram of the tunnel under construction showing the system of rearward traction.

Trailers, R, shown schematically in FIG. 7, are installed behind and attached to the machine. These trailers, which are known per se in the technique of terrestrial tunnel boring machines, carry the auxiliary equipment necessary for the operation of the machine, the logistics for supplies of all kinds such as for example cavity grout, compressed air, electricity, water, ventilation, tunnel segments, etc.

This machine suitable for operating in immersion comprises a working space (6) and a ballastable chamber (7) and if necessary a counterweight compartment shown schematically as L. The counterweights are intended to locally and temporarily compensate any tunnel weight insufficiency with respect to buoyancy.

The working space (6) is fluid-tight peripherally and at the front (in the direction of tunnel advance) and it is connected to the portion of tunnel already built by a fluid-tight tailskin (27). The working space is designed to accommodate personnel and everything necessary to at the least build the standard section to be built.

For example, the standard section of tunnel is a ring made up of precast segments which are conveyed, through the portion of tunnel already built, to the working space from the bank or shore as required, and the working space is equipped with appropriate means (erector arms, for example) for grasping the segments and placing them so as to build an annular section.

These means may be similar to those used in terrestrial tunnel boring machines designed to build and erect the segments of a ring for a tunnel in a bored body of rock.

FIG. 2 therefore shows merely a schematic representation of these means of construction and erection using a transverse pivoting arm (8) solidably mounted on a longitudinal support (8') and designed to grasp a segment of a section and place it in its service position.

To keep the figure uncluttered, the stock of segments waiting to be grasped and erected is not shown.

It shows only one of the segments, V, of the ring T7, in the cross section on FIG. 2.

Figure 5:
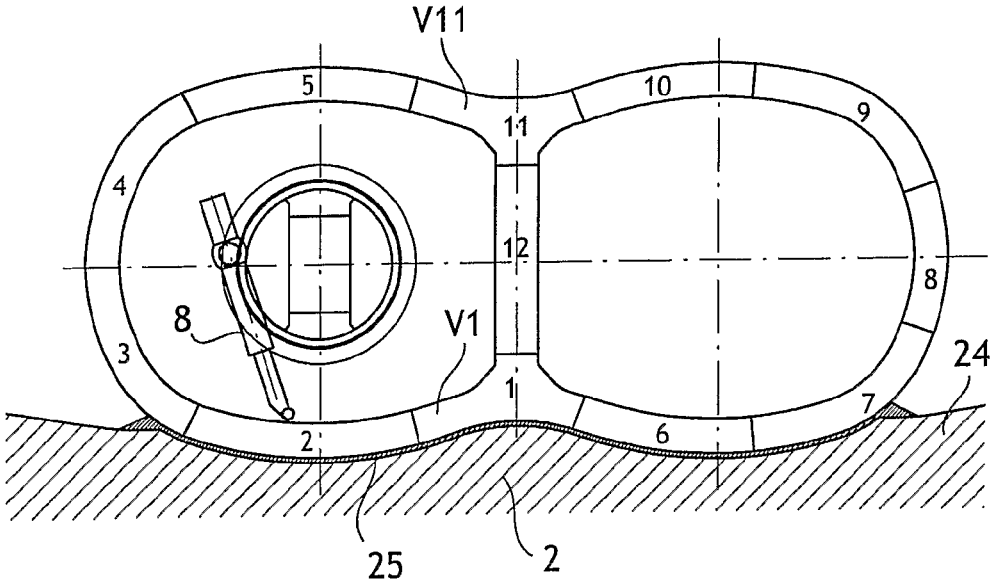

In the construction represented for the example, the ring consists of eleven segments, V, numbered (V1) to (V11) on FIG. 5 and a vertical central wall (12) separating the two cells of the tunnel.

Seals (not shown) ensure fluid-tightness between segments and between sections in a manner known per se in the technique of segmental construction of terrestrial tunnels.

The working space (6) is equipped with rams P for:

pushing the machine forwards to create the space necessary for erecting an annular section of tunnel;

steering and guiding the machine on the soil;

exerting longitudinal prestress on the tunnel walls in order to keep the seals between rings compressed and contribute to the longitudinal stability of the last rings placed.

These rams push against, on one hand, a frontal wall (14) constituting a shield in front of the working space and, on the other hand, the last section erected. To erect a new segment in a section, the rams are activated against the section segments erected previously, with the exception of that behind the new segment to be erected, as is shown on FIG. 2 where ram P1 has been withdrawn for erection of segment V.

Figure 4:
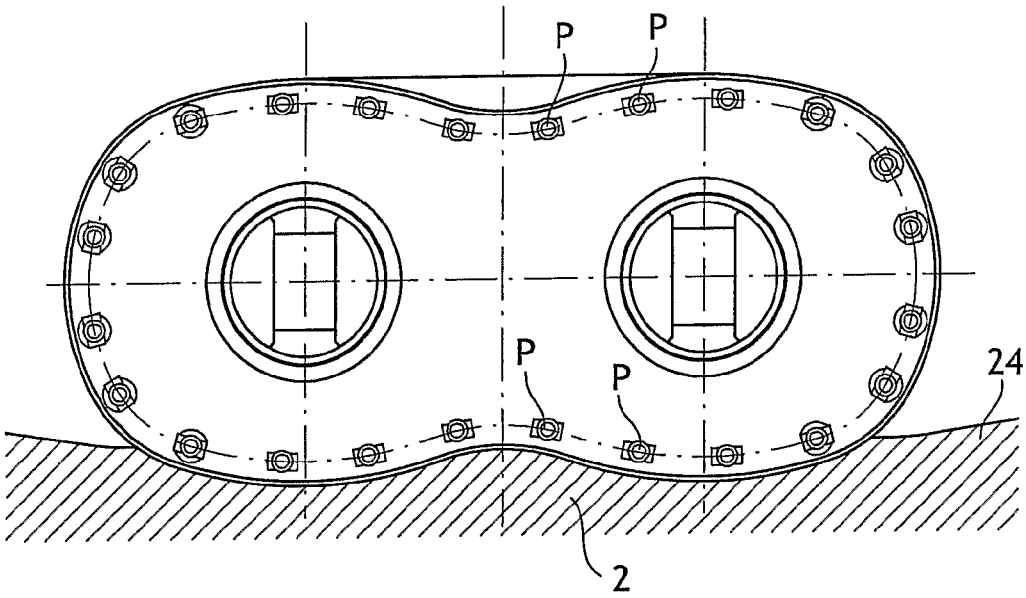

In practice, as is shown on FIG. 4, there is preferably at least two ram per section segment.

In front of the working space (6), the machine has a ballastable chamber (20) open at the front and bottom which contains arms (21) mounted so as to pivot forwards and backwards and laterally, and which can be displaced on one or more horizontal beams (22).

These arms carry grading tools (23).

Figure 6:
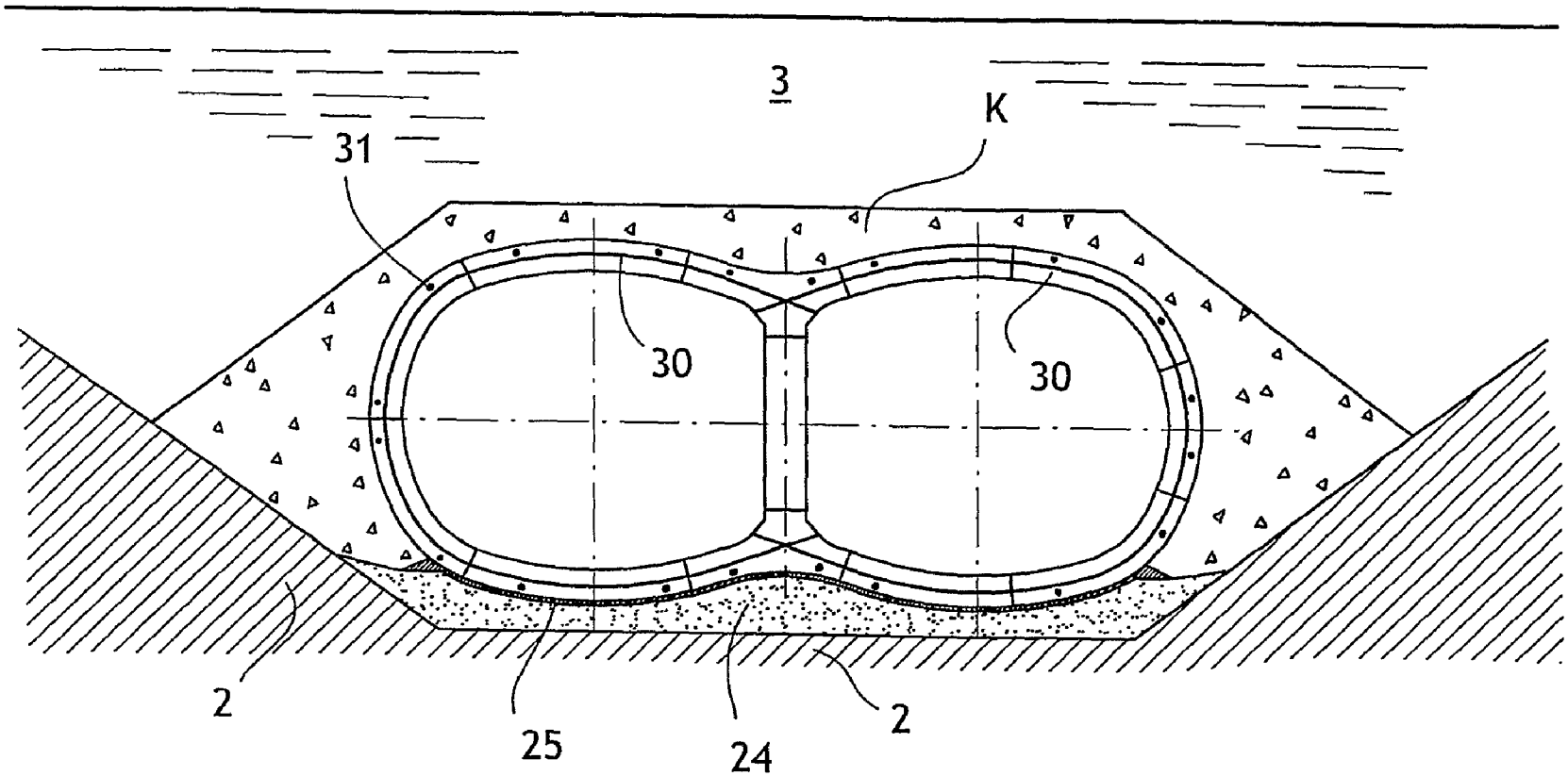
FIG. 6 is a cross section of a standard section of a completed tunnel.

Most commonly, as can be better seen on FIG. 6, once the bottom (2) of the trench has been prepared, by dredging from the surface, for example, an over-thick foundation layer (24) is placed on the bottom and the grading tools of the machine are used to scrape the excess thickness (24*a*) at the top ahead of and to the sides of that layer as is shown on FIG. 2, and thereby shape the formation layer.

When a section has been erected, and at the same time as the machine advances, a tunnel bearing layer (25) is injected beneath the section (FIG. 5) from the machine which is equipped for this purpose (equipment not shown on the figures) to compensate the thickness of the tailskin (27) of the machine (see FIG. 7).

In the working space (6) there is a device (26) for injecting compressed air into the ballastable chamber, above the water therein.

This injection serves to control the inclination and guidance of the machine in the vertical plane and to adjust the bearing force of the front part of the machine on the soil.

To ensure machine pressure on the tunnel and compression of the seals between the tunnel sections, in the absence of sufficient hydrostatic thrust at the front of the machine (in the case of shallow tunnel depth and, in all cases, in the approach zones where the tunnel is not or is only slightly immersed), a tensile force in the direction of the tunnel is exerted on the machine, by means of a ram or winch type device (28) placed in the tunnel or on the launching bank or shore and connected to the machine, by cables (29) for example (29).

These means have been shown only schematically on FIG. 7.

When the hydrostatic pressure on the section is insufficient, the sections are prestressed transversally, as shown schematically in the form of cables (30) on FIG. 6.

Sections may be tied to each other, for example by interlocking connectors, by bolting and/or by temporary or permanent prestressing bars or cables (31) as shown schematically on FIG. 6.

Being normally intended to link two shores or banks, the tunnel has two approach portions which are preferably also built with the machine.

The invention is not limited to the examples described.

The invention claimed is:

1. A process for building a wholly or partially immersed tunnel on a natural or artificial sub-sea soil, wherein the tunnel is built in successive tunnel sections, characterized in that a standard immersed section is built on the sub-sea soil by means of a machine suitable for operating in immersion that is moved forward in the water, on the sub-sea soil, as required, along the proposed tunnel alignment, said machine comprising a fluid-tight working space at atmospheric pressure suitable for accommodating the personnel and equipment necessary for the construction and in situ erection of the section, in that the tunnel is kept fluid-tight as it is built, in that a sufficiently large communication space is kept open between the part of tunnel already built and the working space of the machine to allow construction and erection of a new section, in that the tunnel is used, as it is being built, to transport the component parts of the sections to the machine as required, and in that the sub-sea soil is prepared by dredging a trench along the proposed alignment for erection, placing foundation material on the bottom of said trench as a foundation layer, and said machine comprising arms carrying grading tools, mounted so as to pivot forwards, backwards and laterally, grading said foundation layer, to scrape the excess thickness at the top of that layer and to the sides of that layer.

2. The process according to claim 1 wherein the tunnel is built in successive sections less than three meters long.

3. The process according to claim 1 wherein the machine is used to partially or totally prepare the sub-sea soil, as the machine advances, for erection of the tunnel, using tools integrated into said machine.

4. The process according to claim 1 wherein the soil is consolidated or the bearing capacity of the soil is improved, as the machine advances, using means integrated into said machine or from inside the tunnel already built.

5. The process according to claim 1 wherein the machine is made to advance on the sub-sea soil by thrusting off from the tunnel already built.

6. The process according to claim 5 wherein this thrust is exerted by rams.

7. The process according to claim 5 wherein this tensile force is exerted by means of a pulling device connected to the machine by a cable running through the part of the tunnel already built.

8. The process according to claim 1 wherein a restraining tensile force directed towards the part of tunnel already built is exerted on the machine, as required, to facilitate machine guidance, compress the transverse joints, and ensure the temporary stability of the last sections erected, when the frontal hydrostatic thrust on the machine is insufficient.

9. The process according to claim 1 wherein the machine is equipped with a ballastable compartment, to adjust the bearing force of the machine on the soil and to facilitate its guidance in the vertical plane.

10. The process according to claim 9 wherein tools for grading and/or consolidating the soil or improving the bearing capacity of the soil are located in the ballastable chamber.

11. The process according to claim 1 wherein each section is built in situ by assembling segments of sections by means of a fixed or mobile device placed within the fluid-tight working space, longitudinal fluid-tight seals being placed between segments.

12. The process according to claim 11 wherein the individual stability of a standard section is improved and the fluid-tight seals between segments of the section are compressed by transverse prestressing of the section after its erection.

13. The process according to claim 1 wherein the machine is displaced incrementally on the sub-sea soil ahead of the last section erected in order to, on each occasion, create the space necessary for erection of the following section and injection of its permanent foundation.

14. The process according to claim 1 wherein the machine is used to build non-immersed, partially immersed and/or slightly immersed approach portions of the tunnel.

15. A device for implementation of the process according to any of claims 1 to 12 characterized in that it comprises:

a machine (M) suitable for operating in immersion and which comprises a fluid-tight working space (6), under atmospheric pressure internally, suitable for accommodating the personnel and equipment necessary for building a section, this space being open to the part of tunnel already built, allowing a new section to be built;

means (27) for ensuring fluid-tightness around the opening between the working space and the last section built;

means (21-23) for preparing the tunnel foundation;

means (P) for causing controlled forward displacement of the machine on the sub-sea soil as required to provide the space required for building a new section;

means (28,29) for controlling the bearing force of the machine on the sub-sea soil and against the tunnel;

means (R) for conveying the components and energies necessary for construction of sections through the tunnel to the machine.

16. The device according to claim 15 wherein said machine is equipped with means for preparing the soil (21-23) to locally improve the condition of the sub-sea soil in readiness for building tunnel sections.

17. The device according to claim 16 wherein said means of soil preparation comprise means of grading (21-23) and/or means of soil consolidation, whether robotic or otherwise.

18. The device according to claim 17 wherein the means of grading comprise tools (23) for grading the initial soil or a layer placed on said soil beforehand.

19. The device according to claim 17 or 18, wherein the machine comprises means of checking and/or viewing the state of grading.

20. The device according to claim 17 wherein the means of grading comprise grading tools (23) fitted to arms (21) slidably mounted on one or more beams (22).

21. The device according to claim 15 wherein the machine comprises a ballastable compartment (7) for adjusting the bearing force of the machine on the sub-sea soil.

22. The device according to claim 21 and wherein said ballastable compartment (7) is open at the bottom and at the front, the means of grading (21-23)) being housed in or retractable into said ballastable compartment and the machine being equipped with means (26) for injecting compressed air into the ballastable compartment as required.

23. The device according to claim 15 wherein are comprised means for implementing the thrust of the machine against the tunnel when the frontal hydrostatic thrust on the machine is insufficient.

24. The device according to claim 23 wherein said means of traction comprise a pulling device (28) located to the rear of the machine and connected to the machine by a cable (29) that runs through the part of tunnel already built.

25. The device according to claim 15 and which comprises means (P) for exerting thrust on the machine in order to displace it forwards and to control its trajectory in the direction of the tunnel erection alignment.

26. The device according to claim 25 wherein the machine is equipped with rams (P) positioned to exert thrust on the machine by pushing off from the last section built.

27. The device according to claim 15 wherein said working space (6) is equipped with means for handling precast section segments (V) with a view to building a tunnel section.

28. The device according to claim 15 wherein said fluid-tight working space is equipped with means for injecting a filling material (25) into the void left by the machine, when it advances, between the soil (2) and the underside of the sections forming the tunnel.

29. The device according to claim 15 which comprises means of implementing transverse prestress (30) in tunnel sections.

30. The device according to claim 15 which comprises means of implementing longitudinal prestress (31) in tunnel sections.

31. The device according to claim 15 and wherein the machine comprises a counterweight compartment (L).

32. The device according to claim 15 and which comprises precast sections of tunnel of a unit length of no more than a few meters or segments of sections for building such sections.

33. The device according to claim 32 and which comprises precast sections of tunnel of a unit length generally less than about 3 meters or segments of sections for building such sections.

* * * * *